United States Patent [19]

Shaw, III

[11] Patent Number: 4,628,893

[45] Date of Patent: Dec. 16, 1986

[54] BOW HANGER

[76] Inventor: Robert B. Shaw, III, 92 Morrissee Ave., Wallington, N.J. 07057

[21] Appl. No.: 707,246

[22] Filed: Mar. 1, 1985

[51] Int. Cl.[4] ..... F41B 5/00; E04G 5/06; A47B 91/00

[52] U.S. Cl. ..... 124/23 R; 248/227; 248/359

[58] Field of Search ..... 124/88, 23 R, 24 R, 124/DIG. 1, 80; 248/218.4, 225.3, 225.2, 227, 359 G, 359 H, 359 I; 223/85

[56] References Cited

U.S. PATENT DOCUMENTS

| | | | |
|---|---|---|---|
| 1,649,619 | 11/1927 | Slevin | 248/359 G |
| 3,286,961 | 11/1966 | Mandolare | 124/24 R |
| 3,468,508 | 9/1969 | Huver | 248/359 I |
| 3,861,633 | 1/1975 | Rappleye et al. | 248/227 |
| 4,101,107 | 7/1978 | Antoszewski | 248/218.4 |

OTHER PUBLICATIONS

Archery, Jun. 1978, p. 16, Potawatomi Products advertisement.

*Primary Examiner*—Richard C. Pinkham
*Assistant Examiner*—Benjamin Layno

[57] ABSTRACT

A Bow Hanger for archery bows includes steel plate members and a hook within the members. The steel plate members are separated to receive an upper bow limb between two plate members. Each plate member has a pair of holes for receiving screws. Wing nuts are threaded on the screws to retain the hook and plate members in position on the bow. The hook and plate members are positioned onto the bow such that the hook may be adapted to receive a stationary object, thus, vertically suspending the bow from a stationary object when the bow is momentarily not in use.

4 Claims, 9 Drawing Figures

BOW HANGER

BACKGROUND OF INVENTION

This invention relates to archery devices, and more particularly, to a hanger adapted to be rigidly attached to the upper limb of a bow. The hanger enables the bow to be hung on a nail, cable, fencing, tree limb, closet, or on any other object capable of receiving a hanger.

Archers have often been faced with laying their bow on the ground, pavement, bushes, or leaning the bow against an object all of which can cause damage to the bow and its parts. Additionally, both in hunting and on archery ranges the bow is frequently not in use for a period of time, and it would be an advantage to hang the bow properly without requiring that the bow be set aside and thus damage can be done.

SUMMARY OF THE INVENTION

My invention provides a simple quick attaching bow hanger comprising steel plate members and a hook adapted to be received within the members.

It is the principal object of this invention to provide a bow hanger of the character described that will firmly attach to any bow limb such that the hanger may be adapted to receive a stationary object, thus vertically suspending the bow from the stationary object when the bow is not in use in either in the field or archery range.

Another object of this invention is to provide a bow hanger of the character described that is so constructed as to protect the cams on a compound bow, or the bow strings on a recurve bow or straight bow. In addition when the bow hanger is mounted in a suitable location on the upper bow limb, it does not affect, interfere, or alter the balance of the bow when the bow is in use.

Another object of this invention to provide a bow hanger of the character described that does not interfere with the storage of a bow when the bow is stored in a carrying case. The hook can be adjusted on the upper bow limb to owner's satisfaction and comfort.

Still another object of this invention is to provide a bow hanger of the character described that has only two moving parts, namely the wing nuts by which the bow is secured in the steel plate members, in a desired position.

Other objects, features, and advantages of the invention will be readily apparent from the following specifications and the accompanying drawings.

Figure 1:
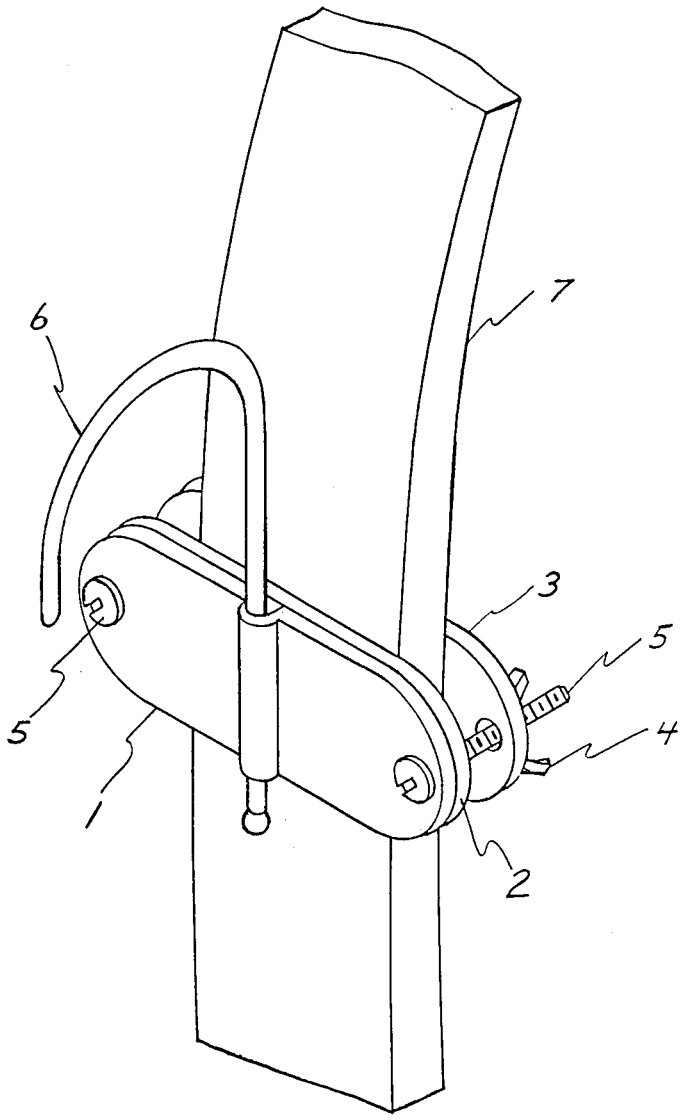
FIG. 1 is a pictorial view of the invention mounted in an intended area on the upper bow limb.
Figure 2:
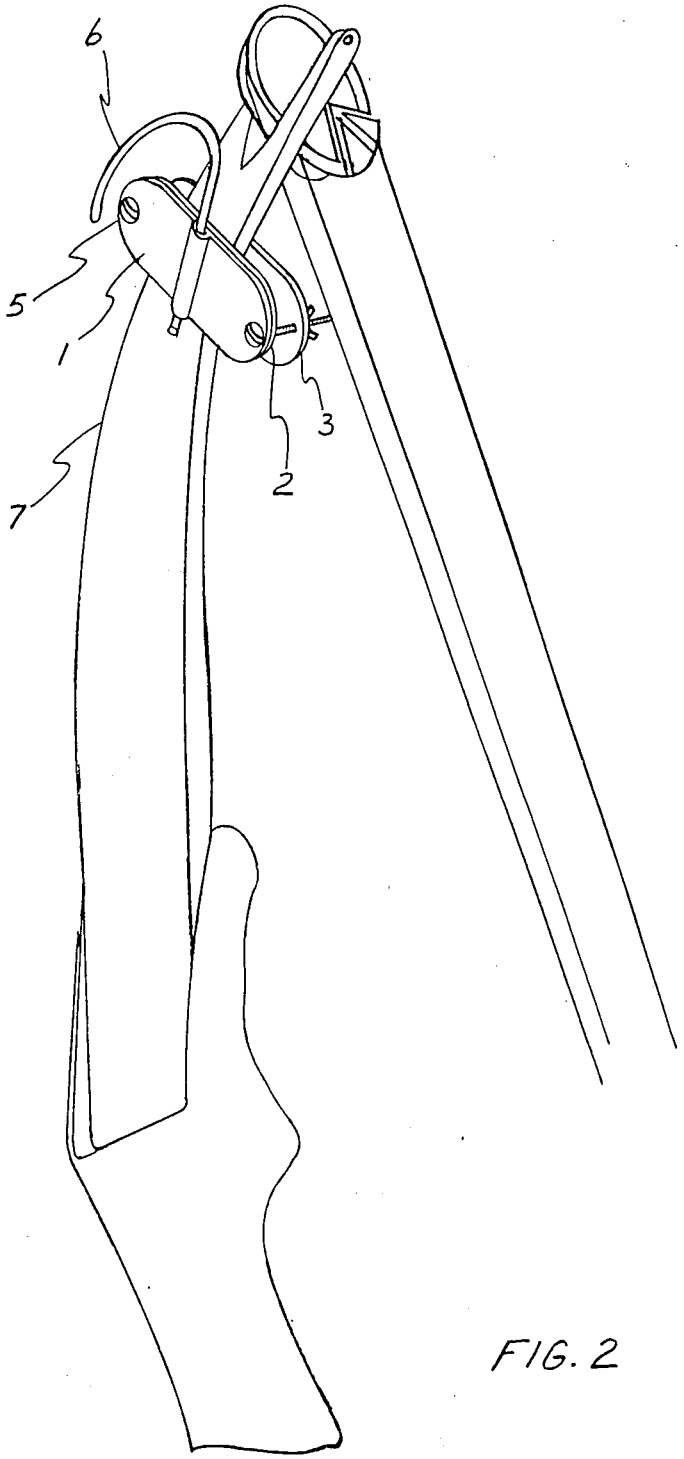
FIG. 2 is pictorial view of the invention mounted on an intended area on the upper bow limb but not interfering with the cam or bow string on a compound bow.
Figure 3:
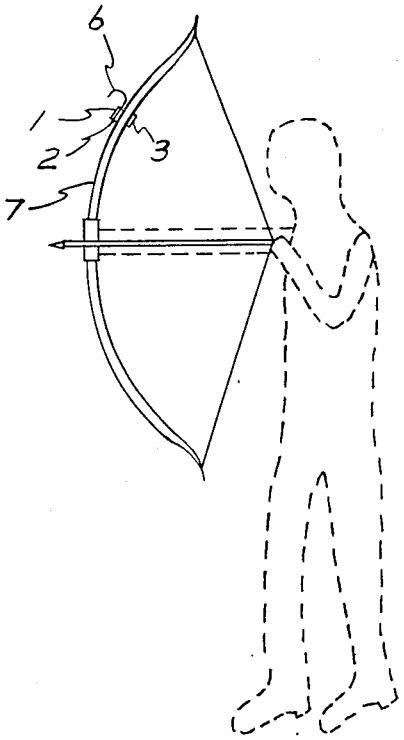
FIG. 3 is a illustration of the archer and the invention mounted on the lower part of the upper bow limb, showing no obstruction of the archer's sight or interfering with the operation of the bow string, or any other mechanical function of the bow. In addition, when the invention is mounted in a suitable location on the upper bow limb, it does not effect or interfere, or alter the balance of the bow when the bow is in use in use.
Figure 4:
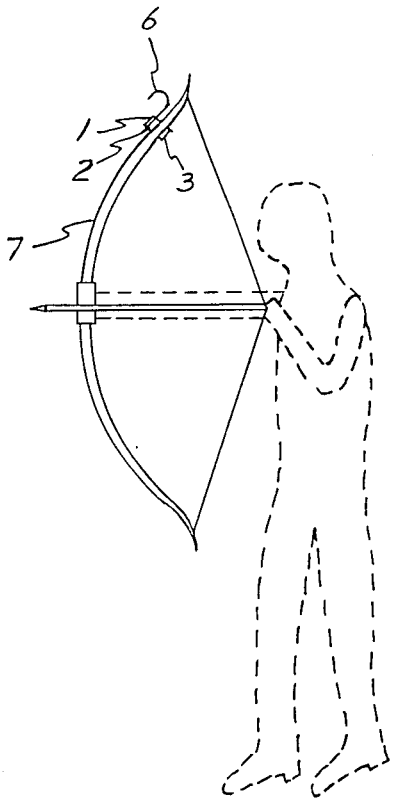
FIG. 4 is a illustration of the archer and the invention mounted on the upper part of the upper bow limb showing no obstruction of the archer's sight or interfering with the operation of the bow string, or any other mechanical function of the bow.
Figure 5:
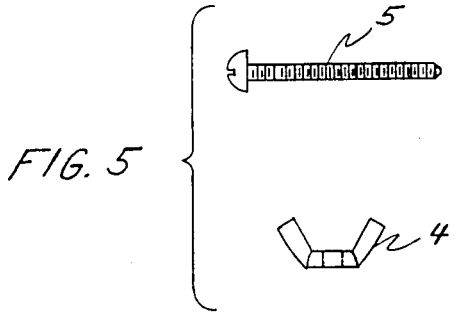
FIG. 5 is an illustration of the fasteners comprising two round head 6–32 by 1½" long screws and two 6-32 wingnuts.
Figure 6:
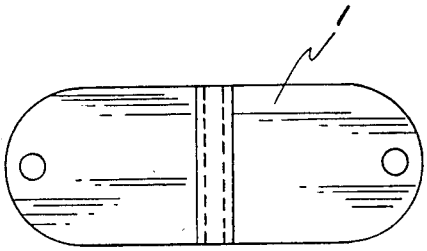
FIG. 6 is a top view of the plate members. Each plate member has two 0.156 inch diameter holes.
Figure 7:
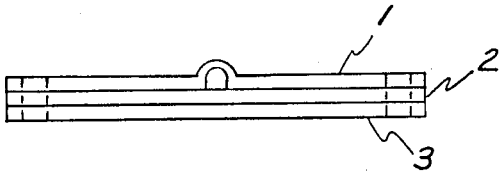
FIG. 7 is a side view of the plate members. The plate members comprise 0.093 inch thick steel plates. Front plate A comprises a 0.125 inch diameter groove stamped to a depth of 0.123 inches.
Figure 8:
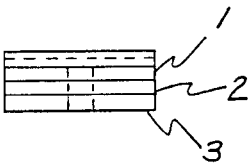
FIG. 8 is an end view of the plates.
Figure 9:
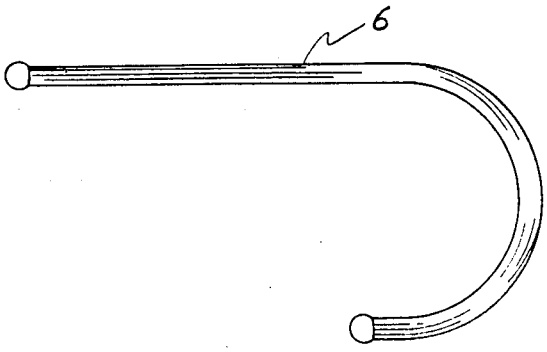
FIG. 9 is an illustration of the hook portion. The hook comprises a 0.125 inch diameter by six inch long steel rod having a straight portion 2.625 inches in length and a bent portion having a 0.750 inch radius. Both ends of the steel rod are peened with a 0.125 inch punch.

I claim:

1. A bow hanger capable of being removably attachable to a bow limb for hanging a bow to a stationary object, said bow hanger comprising, first, second, and third plates wherein said first plate comprises an integrally formed groove portion extending along its width, hook means of rigid material having a first leg for engaging a stationary object and a second leg, fastening means adapted to fasten together said first and second plates wherein a passageway is formed between said groove portion and said second plate, said passageway adapted to receive said second leg for mounting said hook means between said first and second plates, said fastening means further adapted to fasten said third plate to said first and second plates wherein said second and third plates may firmly clamp either side of a bow limb.

2. The bow hanger of claim 1 wherein each of said plates further comprises a pair of holes, said fastening means comprises a pair of screws and pair of wing nuts, said holes adapted to receive said screws for fastening said plates.

3. The bow hanger of claim 1 wherein the hook means is made from a bent one-piece steel rod.

4. The bow hanger of claim 3 wherein the one-piece steel rod is J-shaped and said first leg is the longer end portion of said rod and said second leg is the shorter end portion of said rod.

* * * * *